US005501022A

United States Patent [19]

Cohn

[11] Patent Number: 5,501,022

[45] Date of Patent: Mar. 26, 1996

[54] DECORATIVE BOOT

[76] Inventor: Dianne Cohn, 1315 SE. 1st St., Fort Lauderdale, Fla. 33301

[21] Appl. No.: 328,510

[22] Filed: Oct. 25, 1994

Related U.S. Application Data

[63] Continuation of Ser. No. 733,865, Jul. 22, 1991, abandoned, which is a continuation-in-part of Ser. No. 437,095, Nov. 16, 1989, abandoned, which is a continuation-in-part of Ser. No. 308,538, Feb. 10, 1989, abandoned.

[51] Int. Cl.[6] ..... A41D 17/00

[52] U.S. Cl. ..... 36/2.00 R; 36/100

[58] Field of Search ..... 36/1, 1.5, 2 R, 36/100, 101, 107, 72 A

[56] References Cited

U.S. PATENT DOCUMENTS

| | | | |
|---|---|---|---|
| 1,692,896 | 11/1928 | Hilgert | 36/107 X |
| 2,446,158 | 7/1948 | Miller et al. | 36/2 R |
| 3,193,948 | 7/1965 | Roberts | 36/107 X |
| 3,270,442 | 9/1966 | Liebmann et al. | 36/100 |
| 3,304,629 | 2/1967 | Meyers | 36/100 |
| 3,373,510 | 3/1968 | Memole et al. | 36/2.5 |
| 4,665,633 | 5/1987 | Edgerton | 36/2 R |
| 4,713,895 | 12/1987 | Valliéres | 36/1.5 |
| 4,771,553 | 9/1988 | Smithdeal | 36/1.5 X |
| 4,825,566 | 5/1989 | Sartor | 36/2 R X |
| 4,856,207 | 8/1989 | Datson | 36/2 R |
| 4,896,437 | 1/1990 | Johnson | 36/2 R X |

FOREIGN PATENT DOCUMENTS

| | | | |
|---|---|---|---|
| 0014706 | 6/1911 | Denmark | 36/1.5 |
| 988976 | 9/1951 | France | 36/1.5 |
| 116650 | 4/1900 | Germany | 36/4 |
| 0006973 | 5/1893 | United Kingdom | 36/2 R |

*Primary Examiner*—Paul T. Sewell
*Attorney, Agent, or Firm*—Joseph Zallen

[57] ABSTRACT

A decorative boot having interchangeable tubular decorative components adapted to lie substantially smoothly on the outer surface of the boot between the top of the boot and the ankle portion so as to leave the heel and toe portions uncovered.

3 Claims, 6 Drawing Sheets

DECORATIVE BOOT

This is a continuation of patent application Ser. No. 07/733,865, filed Jul. 22, 1991 by the applicant, which application is now abandoned, which is a continuation-in-part of application, Ser. No. 07/437,095 filed Nov. 16, 1989 now abandoned, which in turn is a continuation-in-part of application, Ser. No. 07/308,538 filed Feb. 10, 1989 now abandoned, both of which applications are incorporated herein by reference.

BACKGROUND OF INVENTION

This invention relates to a decorative dress boot. In particular it relates to a dress boot which has interchangeable decorative components.

In the prior art relating to coverings for boots and shoes, there is no disclosure of a dress boot which has interchangeable decorative components. The patent to Sartor, U.S. Pat. No. 4,825,566 describes an elastic covering element for a ski boot. Meyers, U.S. Pat. No. 3,304,629, describes a theatrical boot used with conventional shoes. Memole, et al., U.S. Pat. No. 3,373,570 and Liebmann, et al., U.S. Pat. No. 3,270,442 relate to dress shoes rather than boots. Johnson, U.S. Pat. No. 4,896,437 relates to a removable insulating liner.

One object of the present invention is to provide a novel, easily interchangeable, decorative component for a dress boot.

Other objects and advantages of this invention will be apparent from the description and claims which follow, taken together with the appended drawings.

SUMMARY OF INVENTION

The invention comprises generally a decorative dress boot characterized as permitting the user to readily exchange one decoration for another. A dress boot usable in this invention typically has a leg portion, a toe portion, and a heel portion. The decorative component is made from a non-elastic, flexible material such as leather, is tubular and is adapted to slip over, surround, and lie substantially smoothly on the surface of the boot from the upper edge of the boot to the ankle portion, thus covering the leg portion but leaving the toe and heel portions exposed. A vertical zipper may be provided to aid in the ease of installation. In some instances joining means such as clips can be provided on the upper edge of the boot. It is preferred that the decorative combination have a lining attached thereto which is essentially non-stretchable transversely.

SPECIFIC EXAMPLES OF INVENTION

Figure 1:
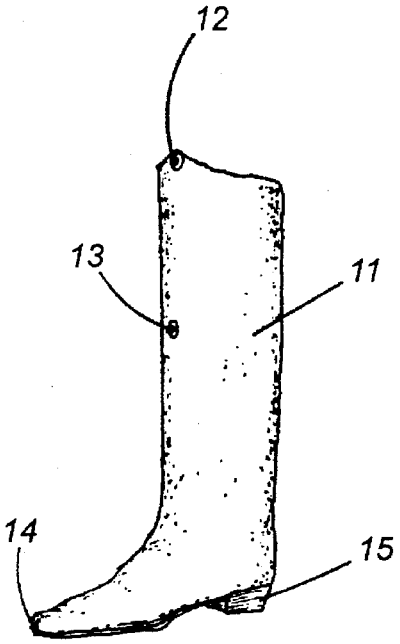
FIG. 1 is a three-quarter side view of a conventional boot having joining elements adapting it to be combined with a decorative component.
Figure 2:
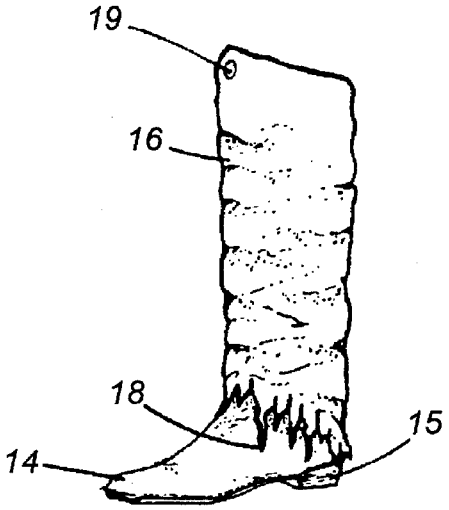
FIG. 2 is a three-quarter side view of the boot of FIG. 1 wherein a decorative component has been attached.
Figure 3:
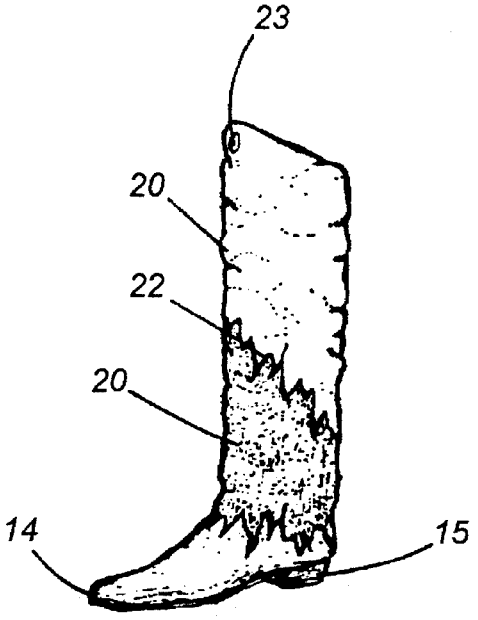
FIG. 3 is a three-quarter side view of the boot of FIG. 1 with a different style decorative component of essentially the same size and structure as the decorative component shown in FIG. 2.
Figure 4:
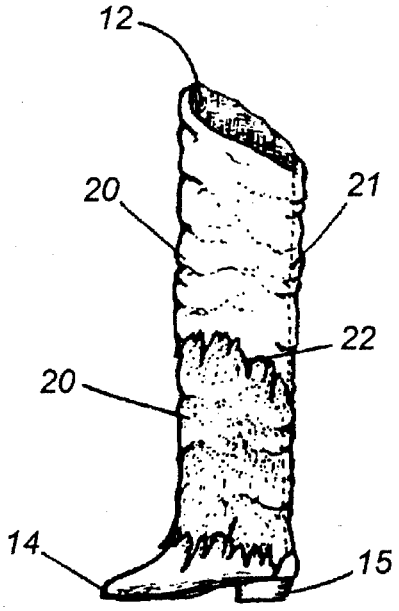
FIG. 4 is a three-quarter rear view of the boot of FIG. 3.
Figure 5:
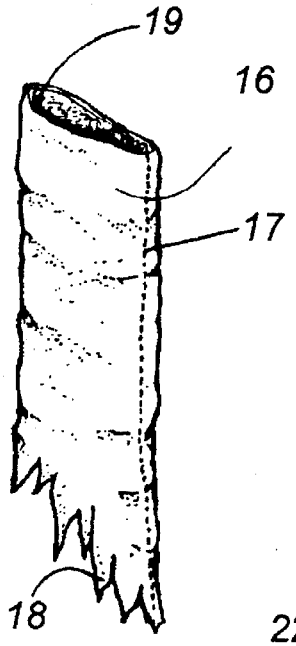
FIG. 5 is a three-quarter rear view of the decorative component for the boot of FIG. 1.
Figure 6:
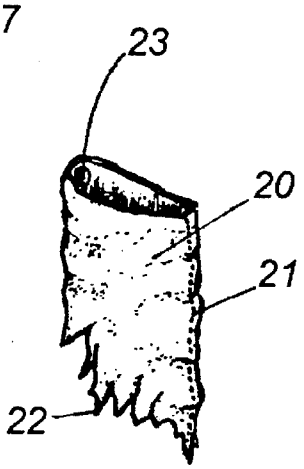
FIG. 6 is a three-quarter rear view of a decorative component for a short boot as in FIG. 7.
Figure 7:
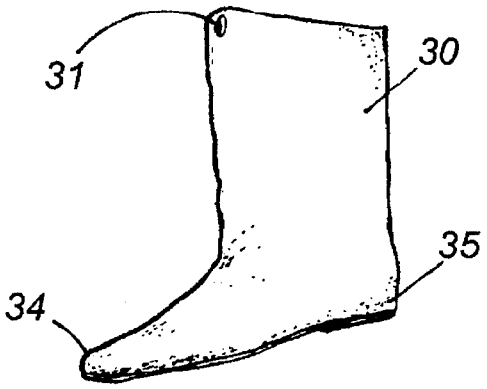
FIG. 7 is a three-quarter side view of a short boot adapted to receive a decorative component.

Referring now to the embodiment of FIGS. 1–9, a high leather boot 11 is illustrated, having a toe portion 14, a heel portion 15, and upper and median front snaps 12 and 13. An elongated tubular decorative component 16 adapted to lie substantially smoothly on the boot is fitted over the boot 11 and attached by its snap element 19 to upper boot snap element 12. Decorative component 16 is preferably made of leather and has a back seam 17 with a decorative jagged edge 18 on its bottom, as shown in FIG. 5. The boot 11 with decorative component 16 attached is illustrated in FIG. 2.

In addition to having a single tubular decorative component extending from the top of the boot to the ankle section so as to expose the heel and toe as shown in FIG. 2, the decorative component may consist of two portions, 20 and 120, each being somewhat shorter but when overlapped covering essentially the same area as the single component 16. In the illustrated instance, components 20 and 120 are essentially similar in construction but so arranged that component 120 is of a different exterior appearance and is attached to boot snap 13. Component 20 is attached to boot snap 12 and overlaps the decorative component 120. Components 20 or 120 or those of similar construction can be used singly with short boots.

Figure 8:
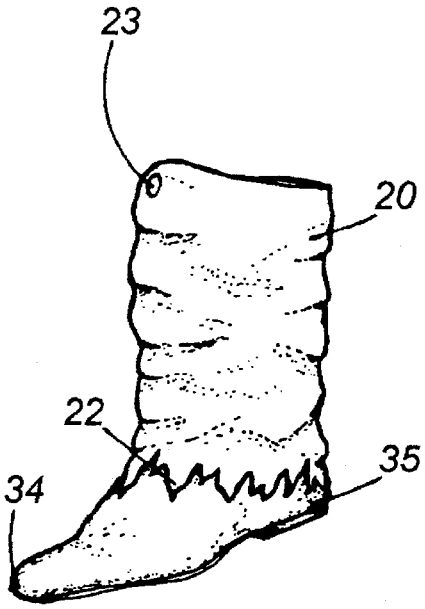
FIG. 8 is a three-quarter side view of a short boot to which a decorative component has been attached.
Figure 9:
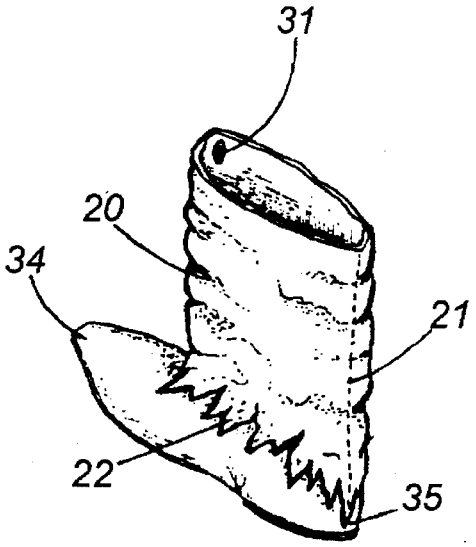
FIG. 9 is a three-quarter rear view of FIG. 8.

The embodiment illustrated in FIGS. 6, 7, 8, and 9 relates to a short boot. Short boot 30 having a toe section 31 and a rear heel section 32 has an upper front snap 31. Tubular decorative element 20 has a rear seam 21, a decorative bottom edge 22, and an upper snap 23. As shown in FIGS. 8 and 9 the tubular element 20 slips over the boot 30, and the snaps 23 and 31 cooperate to hold a decorative element firmly in position on the boot.

The basic boot is preferably made of smooth leather. The decorative elements can be made of a variety of flexible materials such as suede shammy or soft leather, can have various indicia or designs printed or embossed thereon, and can also be of different colors. The decorative elements can have a smooth bottom edge as well as a ragged bottom edge and can be adorned with stones, holes, or fringes.

Although FIGS. 1–9 illustrate the use of snaps, buttons and button holes can be substituted for the snaps. In such case the bottom hole would be preferably in the boot, and the button on the decorative element. The button hole can have an inner flap to isolate the button from the wearer's leg.

Figure 10:
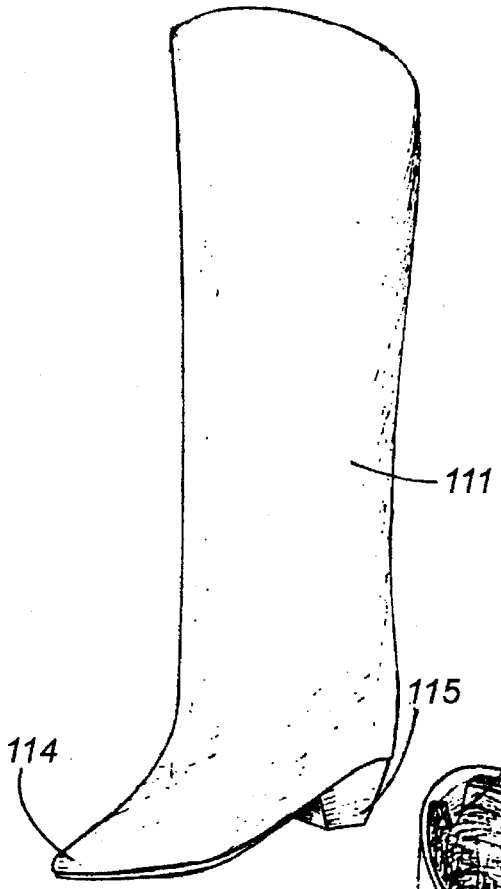
FIG. 10 is a three-quarter side view of a conventional boot.
Figure 11:
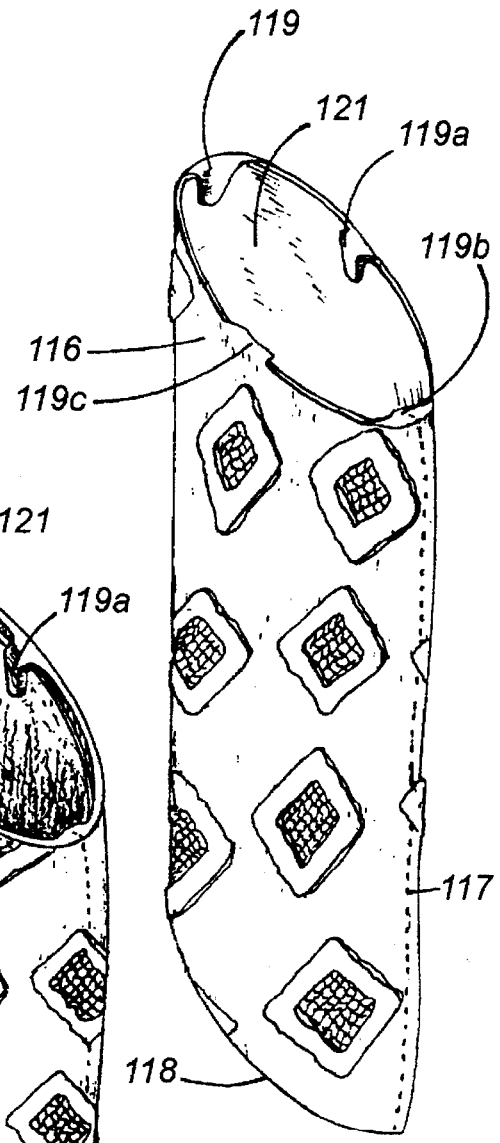
FIG. 11 is a three-quarter rear view of a different embodiment of a tubular decorative component.
Figure 12:
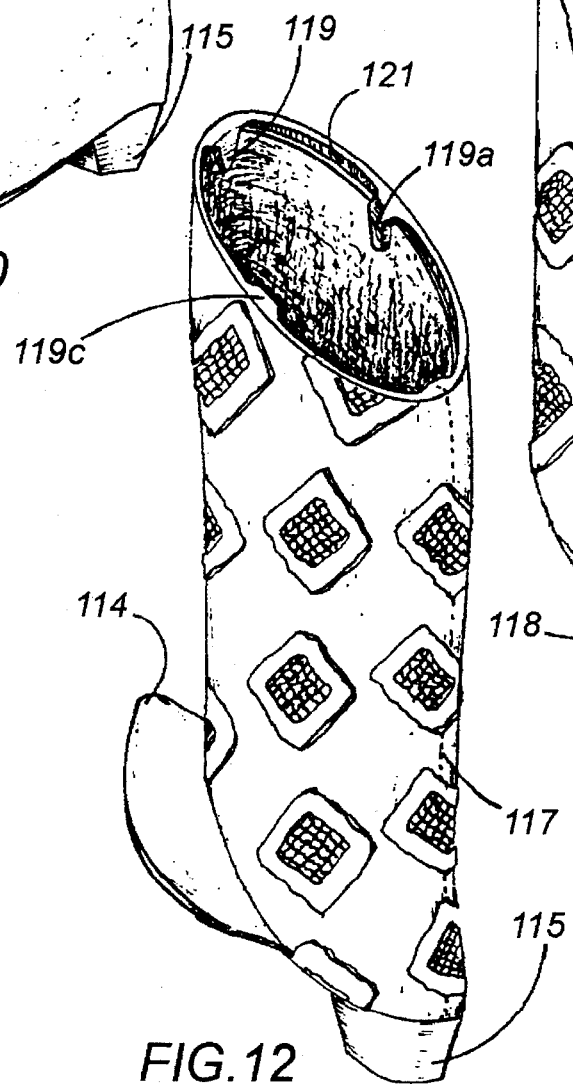
FIG. 12 is a rear view of the assembly of the component of FIG. 11 over the boot of FIG. 10.

In another embodiment of this invention, as illustrated in FIGS. 10–12, the basic leather boot 111 has a toe portion 114 and heel 115 but no special attachment elements. The decorative leather component 116 has a back seam 117, a smooth interior surface 121, and leather-covered clasp elements 119, 119*a*, 119*b*, and 119*c* dependent from its top edge. The clasp elements can be flexible clips wherein one portion lies on the inner surface of the boot and the other within the decorative component. The clips are preferably covered with soft leather to protect any irritation to the person's leg. Component 116 is sized so as to fit smoothly on the body of the boot from the top edge to the ankle portion, leaving the toe portion 114 and heel portion 115 exposed. The clasp elements hold the decorative component firmly on the boot but are readily released so that the user may quickly change from one decorative component to another.

The decorative component in these embodiments is preferably made of a soft piece of leather such as unborn calf skin and lined with a satin-like material which both keeps the leather piece intact and permits it to slide easily over the boot itself.

Figure 13:
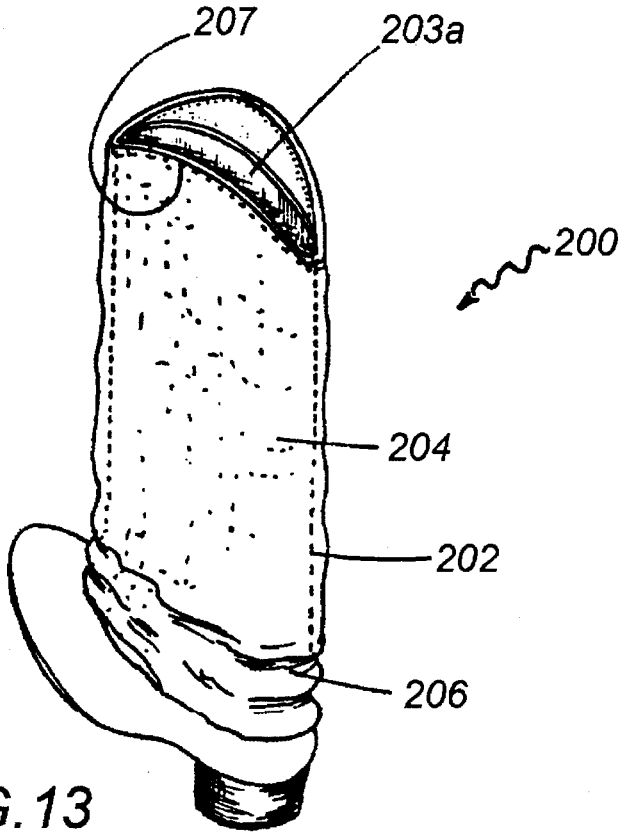
FIG. 13 is a rear perspective view of another embodiment of this invention installed on a boot.
Figure 14:
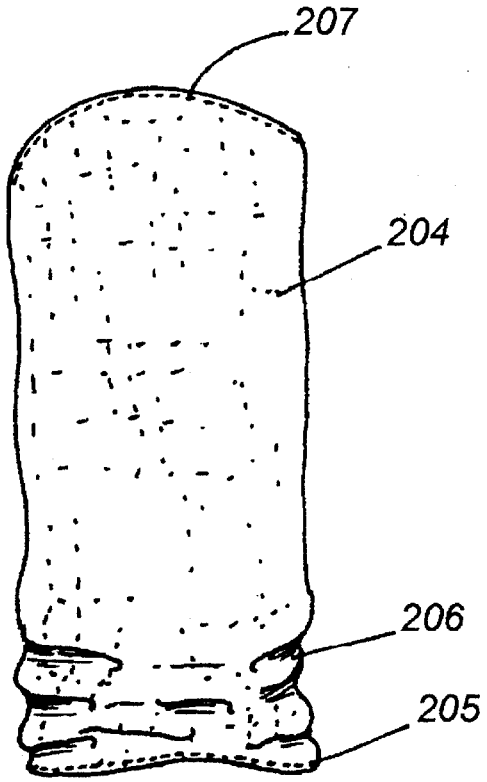
FIG. 14 is a side view of the decorative component of FIG. 3.
Figure 15:
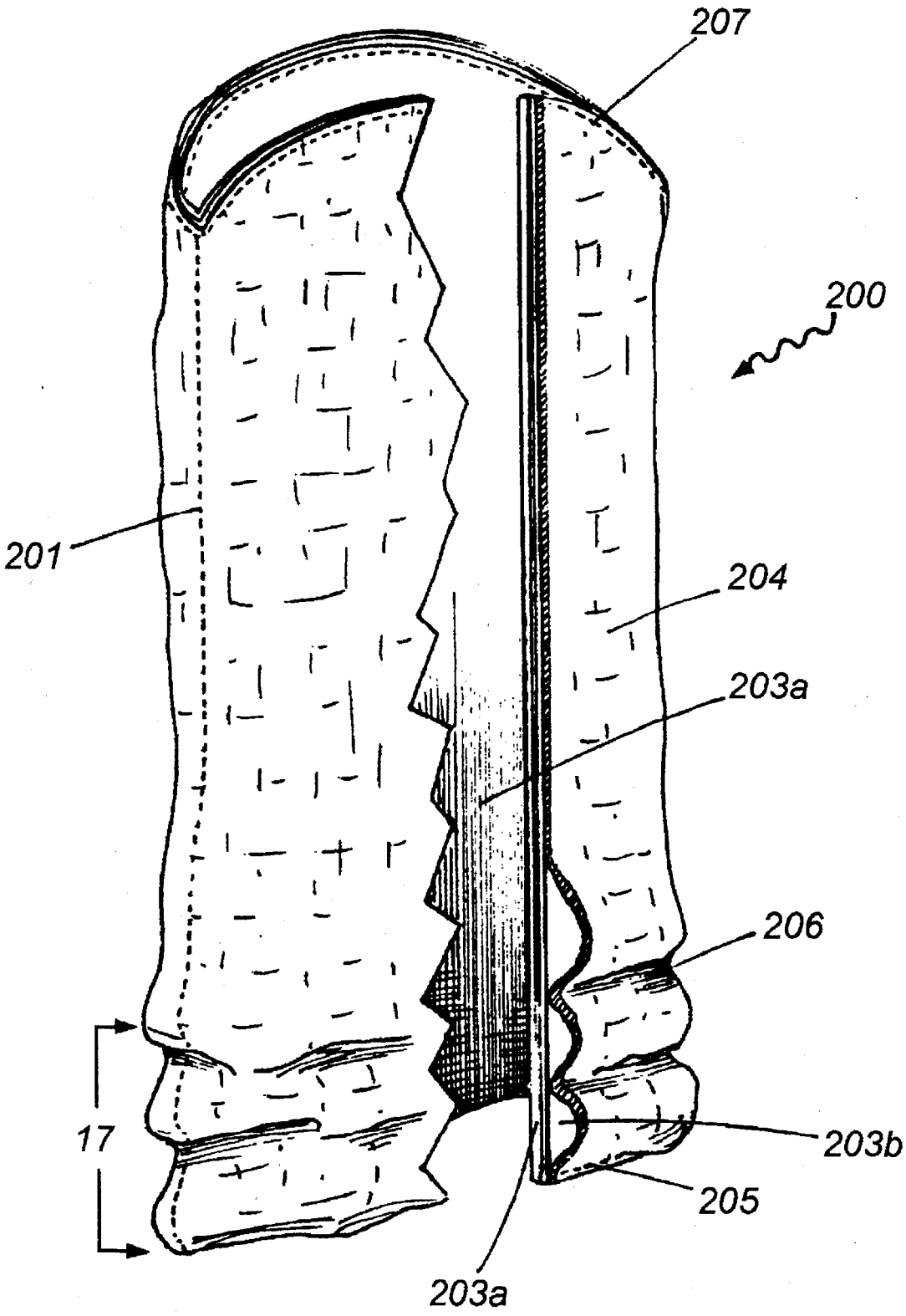
FIG. 15 is a side view with partial cutaway of the decorative component of FIG. 14.
Figure 16:
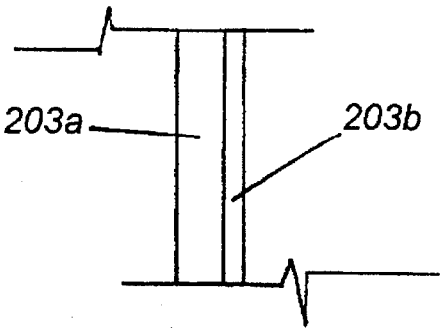
FIG. 16 is an enlarged portion of FIG. 15.
Figure 17:
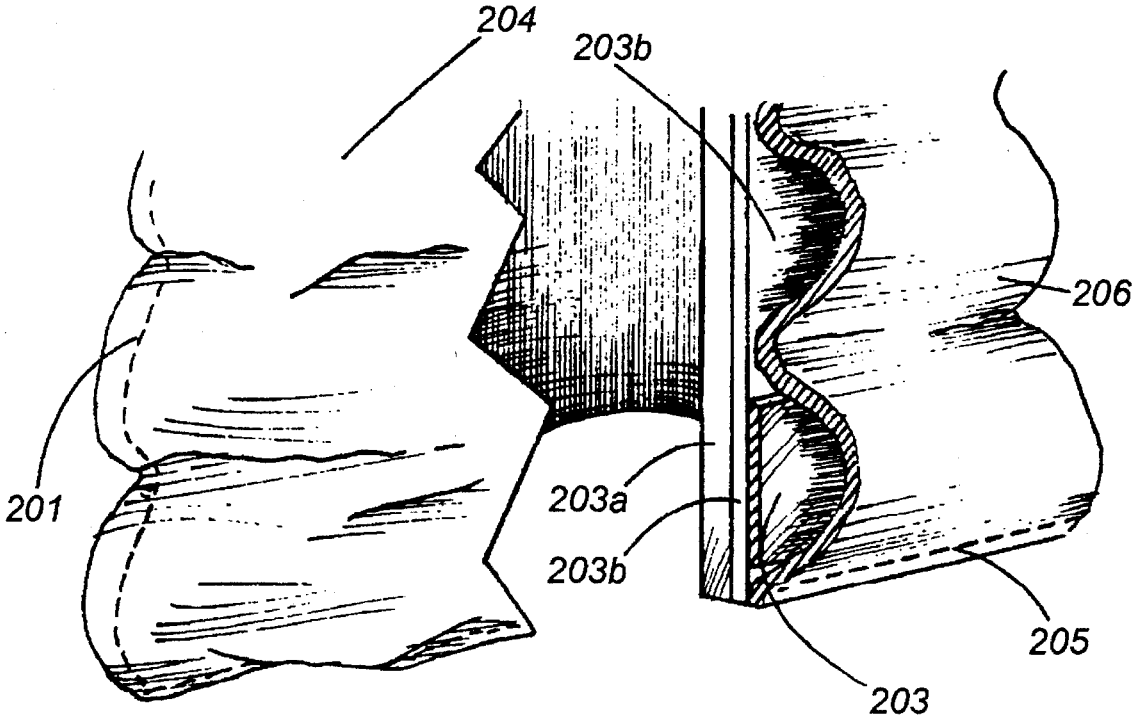
FIG. 17 is an enlarged portion of FIG. 15 showing an elastic band.

In the embodiment illustrated in FIGS. 13, 14 and 15, the decorative component 200 is installed, over a dress boot 150. The component 200 has an outer leather portion 204 with vertical stitching 201 and 202 and horizontal stitching 205 and 207 on lining 203. The outer leather portion 204 is longer than the lining so that the horizontal stitching 205 on the bottom provides a lower, folded, wrinkled section 206. The lining 203 is essentially non-stretchable horizontally. Lining 203 comprises a smooth polyvinyl plastic layer 203*a* facing the boot and a cotton fabric backing layer. In order to minimize any horizontal stretch, elasticized inserts 203*c* can be incorporated in the lining 203.

I claim:

1. A readily removable integral flexible non-elastic decorative component having a fixed tubular shape and being essential non-stretchable transversely, adapted to surround and lie substantially smoothly on the surface of a dress boot; said component extending from the upper edge of the boot to the ankle portion of the boot, thus covering the leg portion but leaving the toe and heel portions exposed; said component comprising a leather exterior portion and an inner smooth lining attached thereto; said outer leather portion being longer than said lining and being stitched to the bottom edge of said lining so as to form a wrinkled portion adjacent the stitching.

2. The component of claim 1 wherein the stitching is horizontal so as to provide a lower, folded wrinkled section.

3. A readily removable, flexible, decorative component comprising a closed, non-elastic, tubular shell essentially non-stretchable transversely, capable of being slipped over a dress boot and adapted to surround and lie substantially smoothly on the surface of the dress boot; said component when installed on the boot extending from the upper edge of the boot to the ankle portion of the boot, thus covering the leg portion and leaving the toe and heel portions exposed; said component comprising a leather exterior portion and an inner smooth lining attached thereto; said exterior leather portion being longer than said lining and being attached to the bottom edge of said lining so as to form a wrinkled portion adjacent the seam.

* * * * *